United States Patent [19]

Javorik et al.

[11] 4,306,437

[45] Dec. 22, 1981

[54] SYSTEM FOR PLANISHING METAL PIPE

[75] Inventors: Laszlo J. Javorik, Oregon; Vernon R. Fencl, Northbrook, both of Ill.

[73] Assignee: Grotnes Metalforming Systems, Inc., Chicago, Ill.

[21] Appl. No.: 101,533

[22] Filed: Dec. 10, 1979

[51] Int. Cl.[3] ..... B21C 37/30

[52] U.S. Cl. ..... 72/75; 72/96

[58] Field of Search ..... 72/75, 96, 97, 77, 78, 72/120, 123, 124

[56] References Cited

U.S. PATENT DOCUMENTS 1,143,101 6/1915 Brinkman ..... 72/75

1,273,475 7/1918 Foster ..... 72/75

3,643,485 2/1972 Marcovitch ..... 72/96

*Primary Examiner*—Lowell A. Larson

*Attorney, Agent, or Firm*—Leydig, Voit, Osann, Mayer & Holt, Ltd.

[57] ABSTRACT

Metal pipe is planished by passing it longitudinally between two concentric circular arrays of independently rotatable planishing elements which are urged against the inner and outer surfaces of the pipe. The two circular arrays of planishing elements are radially aligned with each other on opposite sides of the pipe wall, and the pipe is rotated relative to the two arrays of planishing elements while the pipe is being passed therebetween.

2 Claims, 10 Drawing Figures

SYSTEM FOR PLANISHING METAL PIPE

DESCRIPTION OF THE INVENTION

The present invention relates generally to metal planishing and, more particularly, to the planishing of metal pipe.

It is a primary object of the present invention to provide a planishing system which is capable of planishing relatively long lengths of metal pipe while applying a circularly symmetrical load on the pipe to avoid bending loads. In this connection, a related object of the invention is to provide such an improved planishing system which improves the circular symmetry of the pipe while planishing the pipe.

It is another object of this invention to provide an improved planishing system of the foregoing type which improves the strength, corrosion resistance, and surface smoothness of the pipe.

A further object of the invention is to provide an improved planishing system of the type described above which is capable of expanding or shrinking the pipe while it is being planished.

Still another object of the invention is to provide such an improved planishing system which is not adversely affected by surface roughness on the pipe.

Other objects and advantages of the invention will be apparent from the following detailed description and the accompanying drawings, in which.

While the invention has been shown and will be described in some detail with reference to an exemplary embodiment of the invention, there is no intention that the invention be limited to such detail. On the contrary, it is intended to cover all modifications, alternatives and equivalents which fall within the spirit and scope of the invention as defined in the claims.

Figure 1:
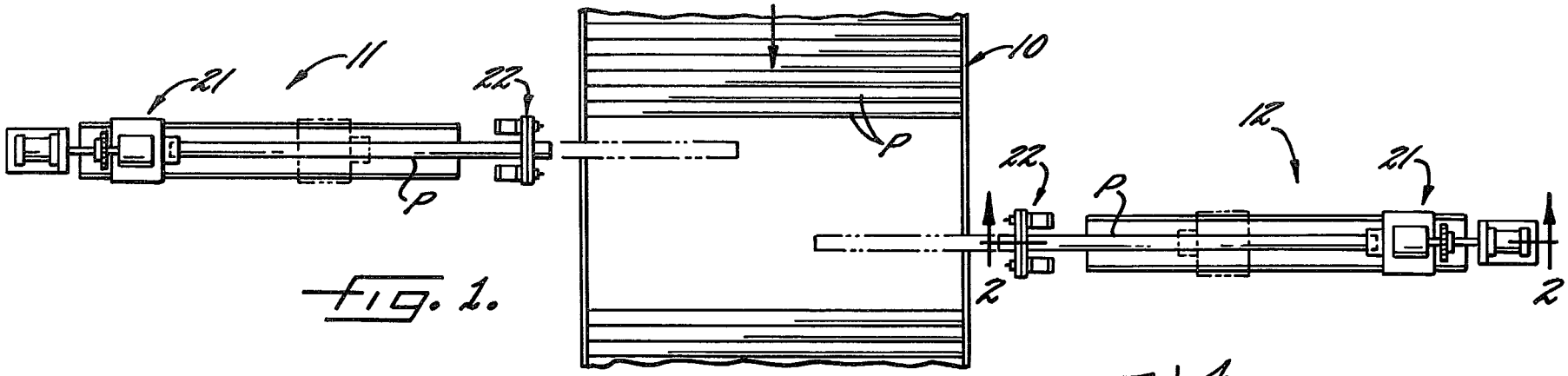
FIG. 1 is a partially diagrammatic view of a pipe planishing system embodying the invention, with separate planishers located at opposite ends of the pipe for sequentially planishing half of the pipe length from one end and then the other half of the pipe length from the other end.

Turning now to the drawings and referring first to FIG. 1, a series of pipes are transported along a conveyor 10 to bring the left end of each pipe into register with a first planishing device 11 for planishing the right-hand half of the pipe. As each pipe drawn from the left planisher 11, it is advanced into register with the second planisher 12 which planishes the left-hand half of the pipe. Thus, in the two successive operations, the entire length of the pipe is planished.

Figure 2:
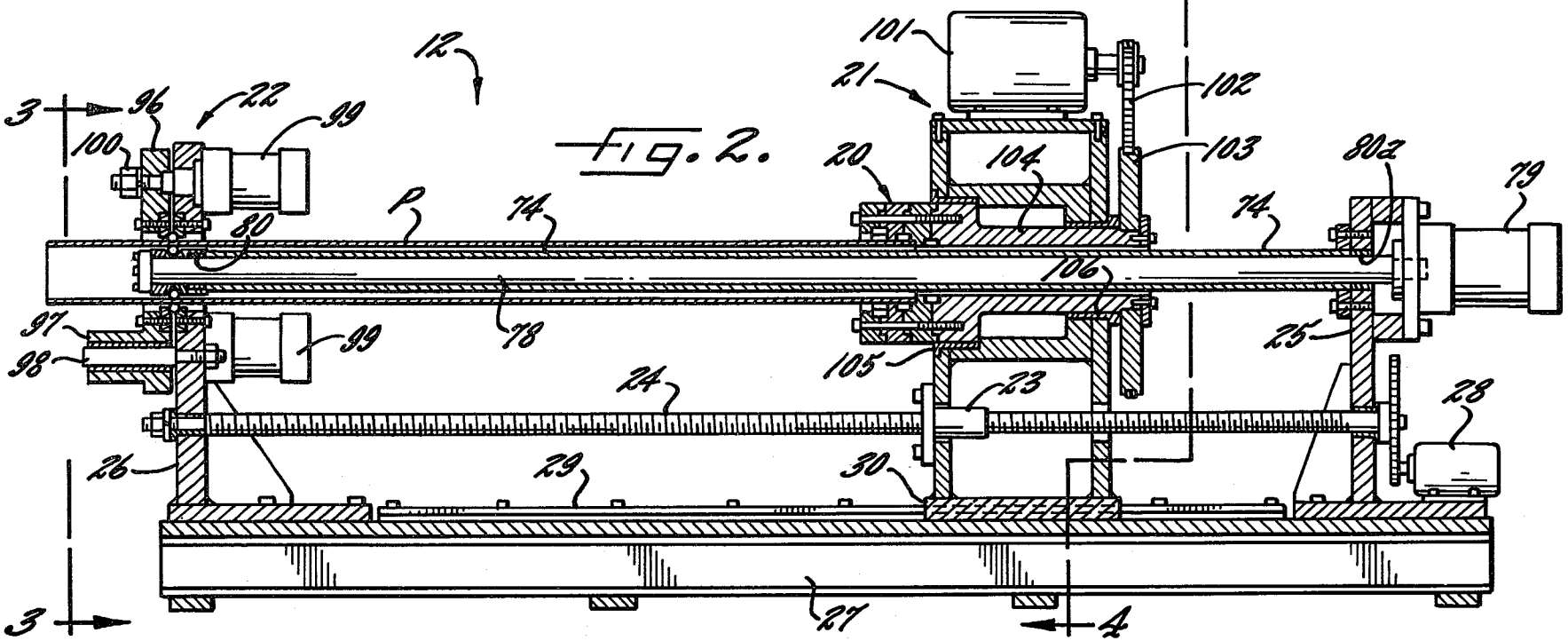
FIG. 2 is a vertical section taken generally along line 2—2 through one of the planishing devices illustrated in FIG. 1.
Figure 3:
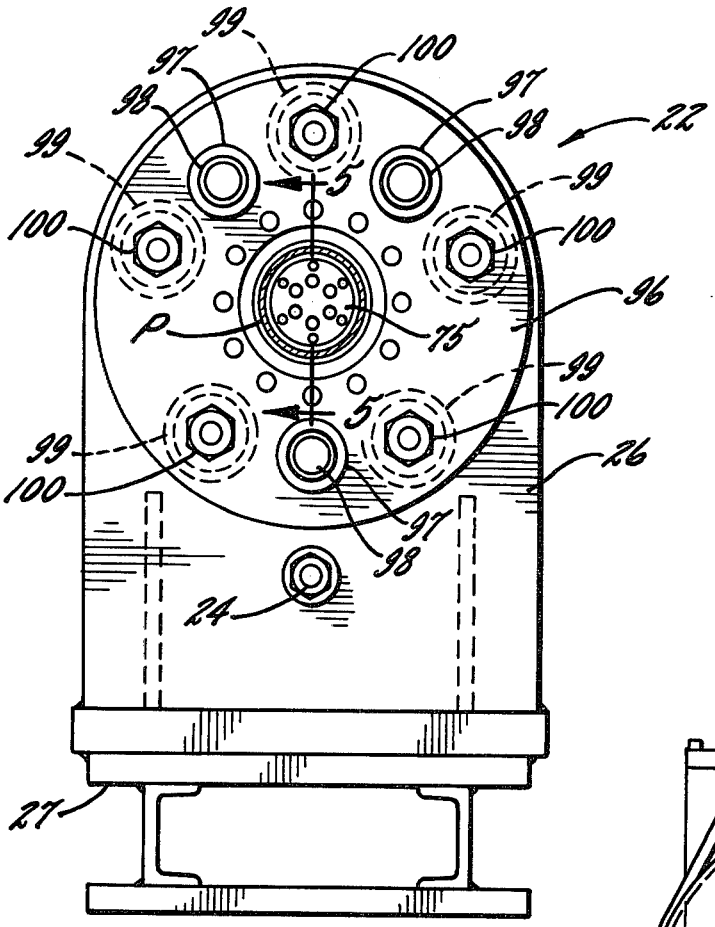
FIG. 3 is an end elevation taken generally along lines 3—3 in FIG. 2.
Figure 4:
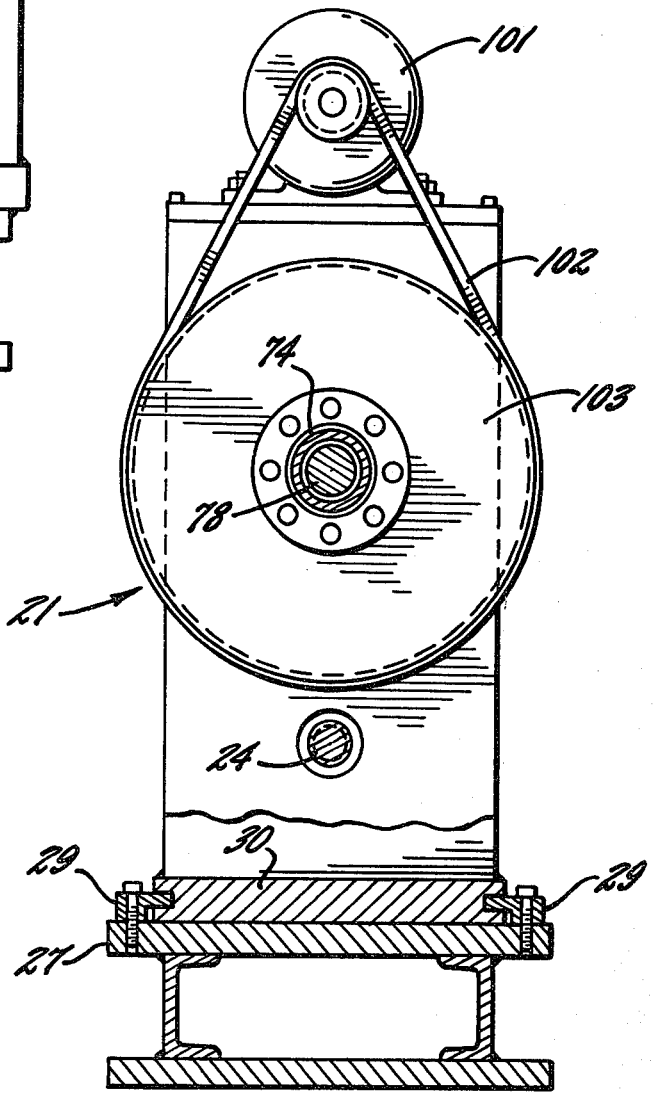
FIG. 4 is a section taken generally along line 4—4 in FIG. 2.

FIG. 2 shows a length of pipe P inserted into the right-hand planisher 12. The right-hand end of the pipe P is held in a chuck 20 of a feed head 21 which feeds the pipe through a planishing head 22 at the left-hand end of the machine. More particularly, the feed head 21 carries a nut 23 which is threaded onto an elongated screw 24 journalled at its opposite ends in a pair of posts 25 and 26 extending upwardly from a base 27. When the screw 24 is turned by drive motor 28, it causes the feed head 21 to move along a pair of tracks 29 mounted on the top of the base 27 and meshing with a guide plate 30 on the bottom of the feed head 21. This traversing movement of the feed head 21 causes the pipe P to pass through the planishing head 22 where both the inside and outside surfaces of the pipe are planished.

In accordance with one important aspect of the present invention, the pipe is passed through two concentric circular arrays of independently rotatable planishing elements which are urged against the inner and outer surfaces of the pipe, the two circular arrays of planishing elements being radially aligned with each other on opposite sides of the pipe wall, and the pipe is rotated relative to the two circular arrays of planishing elements while it is being passed therebetween. The two concentric circular arrays of independently rotatable planishing elements apply a circularly symmetrical load to both the pipe and the planishing machine so that there are no bending loads. Moreover, although both the inside and outside planishing elements are held against the pipe at pressures high enough to work the metal on both the inner and outer surfaces of the pipe wall, a relatively small axial force is required to feed the pipe through the two sets of planishing elements.

In the preferred embodiment of the invention, the planishing elements are in the form of two circular arrays of balls held within a pair of opposed circular races so that the balls are free to roll circumferentially around the raceways, while at the same time applying a continuous radial load on the pipe to effect the desired planishing at the interface of the balls of the pipe. Rotation of the balls in the direction of axial movement of the pipe is resisted by sliding friction with the races, but nevertheless it has been found that a relatively small axial force is required to feed the pipe through the two sets of balls as long as the pipe is rotated while it is being advanced in the direction of its axis.

Furthermore, the radially outward pressure applied to the pipe by the inside set of planishing elements can be made great enough (relative to the pressure applied by the outside set of planishing elements) to expand the pipe while it is being planished. Then when the pipe is allowed to contract upon clearing the planishing elements, even more compaction and higher residual stresses occur in the planished surfaces to further enhance the beneficial effects of planishing. For example, planishing of the pipe surfaces while the pipe is expanded works and compacts the metal in surface layers of the pipe, and this same metal then becomes even more dense and compact when the pipe is allowed to relax and compact. As a result, the surface layers of the final planished pipe have superior corrosion resistance, stress corrosion resistance, yield strength and buckling resistance. This planishing system can also be used to shrink, rather than expand, the pipe while it is being planished, and permanent expansion or shrinkage can be achieved with certain values of D/t (where D is the diameter of the pipe and t is the wall thickness of the pipe).

In addition to the metallurgical properties mentioned above, certain geometric or physical properties of the pipe are also improved by the circular symmetry of the planishing tools and the forces applied to the pipe during planishing. Thus, the circular symmetry of the pipe is improved, as is the uniformity of the wall thickness due to the smoothing out of any rough areas.

Figure 6:
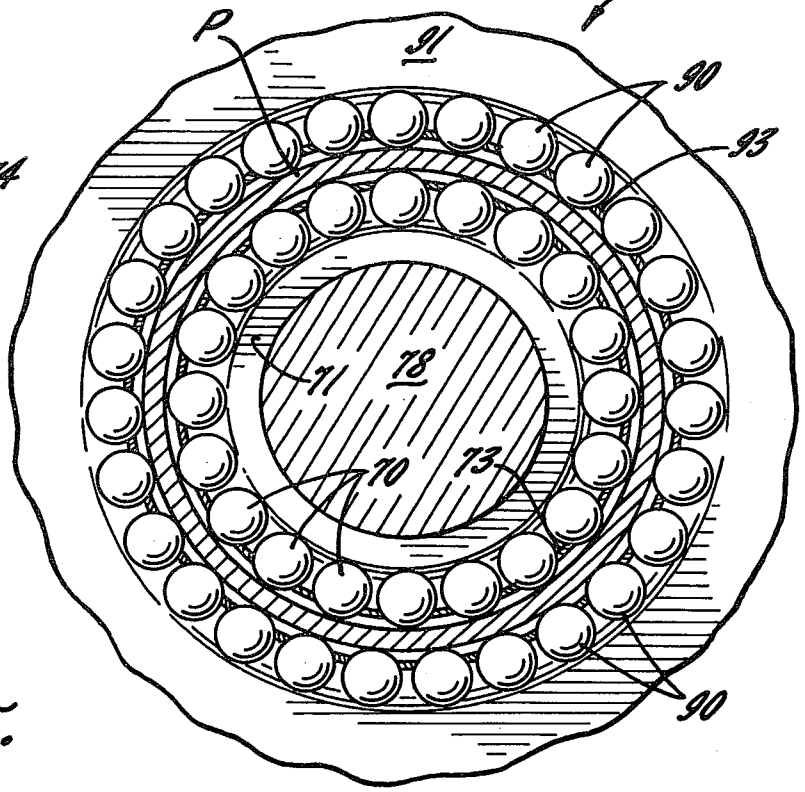
FIG. 6 is a section taken generally along line 6—6 in FIG. 5.
Figure 5:
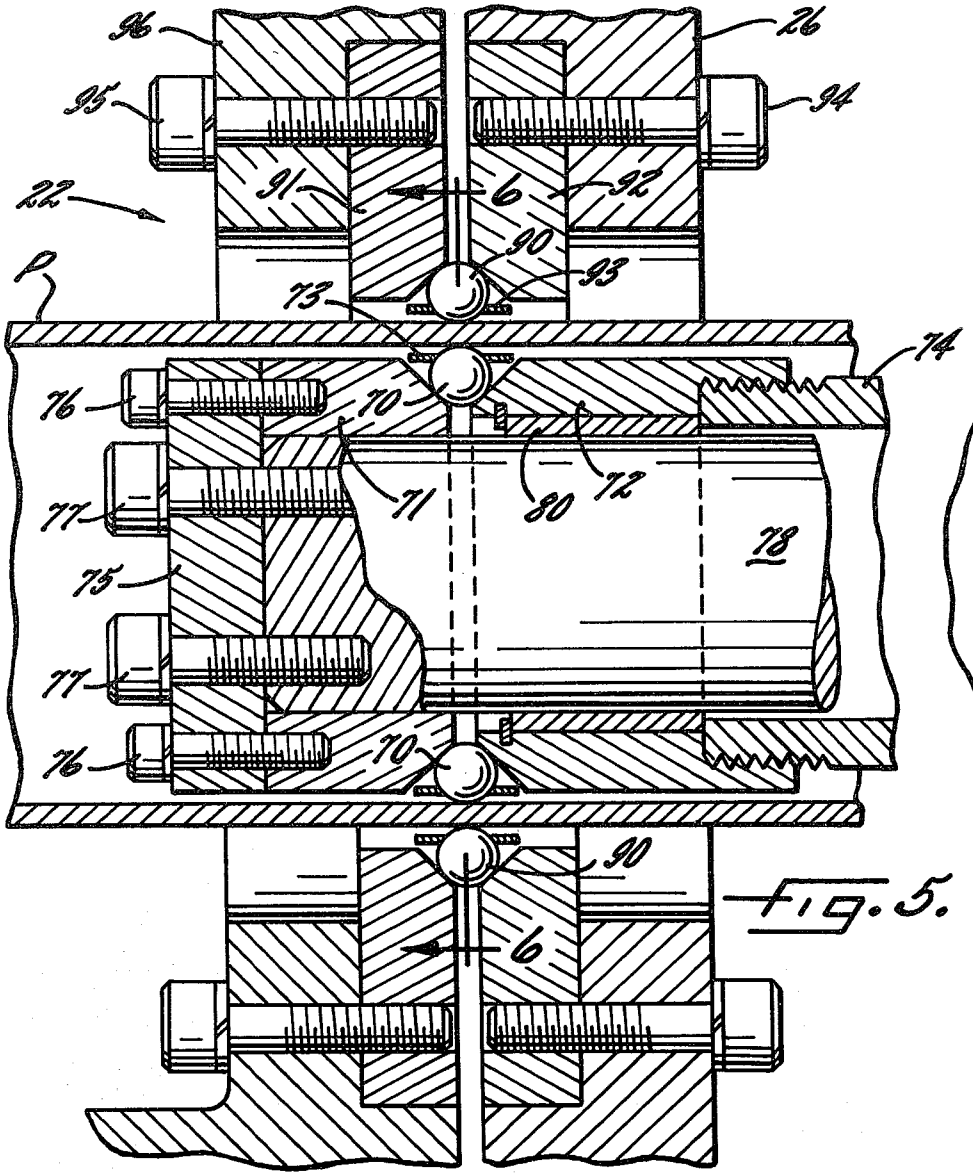
FIG. 5 is an enlarged section taken generally along line 5—5 in FIG. 3 to show the internal structure of the planishing tools.

Turning now to the particular arrangement of planishing tools included in the illustrative machine, and referring particularly to FIGS. 2, 5 and 6, an inside set of steel balls 70 are seated in an annular V-groove formed by a pair of beveled rings 71 and 72. The balls 70 are held in equally spaced relation to each other around the circumference of the V-groove by means of a retainer 73 which forms a multiplicity of evenly spaced apertures to fit over the outer portions of the balls 70 to keep them spaced apart from each other while leaving them free to rotate independently of each other about their respective centers.

The right-hand beveled ring 72 is threaded onto the end of an elongated hollow horn 74 which is fastened at one end to the stationary post 25 and extends horizontally therefrom. For the purpose of forcing the planishing balls 70 outwardly against the inside surface of the pipe P, the left-hand beveled ring 71 is secured by a connecting plate 75 and screws 76 and 77 to a drawbar 78 which is fastened at its extreme right-hand end to a hydraulic cylinder 79. When the hydraulic cylinder 79 is actuated, the drawbar 78 and the beveled ring 71 are drawn to the right as viewed in FIGS. 2 and 5, thereby camming the planishing balls 70 outwardly against the inside surface of the pipe P. To permit smooth gliding movement of the drawbar 78 through the horn 74, the drawbar 78 rides on a bushing 80 secured to the inside wall of the ring 72 and a bushing 80*a* carried by the post 25.

The second circular array of planishing elements in the illustrative machine is formed by an outside set of steel balls 90 carried in the V-shaped groove formed by a pair of beveled rings 91 and 92. As in the case of the inside set of planishing balls 70, the outside balls 90 are held equally spaced from each other within the V-groove by means of a retainer sleeve 93 which forms a multiplicity of equally spaced apertures so that the sleeve can fit over the inner portions of the balls 90 to hold them equally spaced from each other while permitting each ball to rotate independently in any direction about its center. This retainer sleeve also holds the balls in place when there is no pipe in the machine.

The right-hand beveled ring 92 is secured to the stationary post 22 by means of a plurality of screws 94. The left-hand beveled ring 91 is secured by screws 95 to an annulus 96 which carries three guide sleeves 97 for receiving complementary guide rods 98 attached to the frame post 26. Thus, the annulus 96 is mounted for reciprocating movement relative to the stationary frame post 26 in a direction parallel to the axes of the guide rods 98 and parallel to the axis of the pipe P.

For the purpose of advancing and retracting the annulus 96 relative to the stationary post an array of five hydraulic cylinders 99 are mounted on the post 26 with their piston rods extending through the post and connected to the annulus 96 by means of nuts 100. When the hydraulic cylinders 99 are actuated to draw the annulus 96 toward the post 26 the planishing balls 90 are cammed inwardly against the outside surface of the pipe P.

It can be seen that the two sets of planishing balls 70 and 90 are positioned in radial alignment with each other on opposite sides of the pipe wall. When the hydraulic pressure exerted by the cylinders 79 and 99 is released from the two moveable rings 71 and 91 the pipe P can be passed between the two sets of planishing balls for insertion into the feed head 21. After the end of the pipe has been secured within the chuck 20 of the head 21, the hydraulic cylinders 79 and 99 are both actuated to force the planishing balls 70 and 90 against the opposite walls of the pipe P with a high pressure. The pipe P is then fed slowly through the two sets of planishing balls by driving the screw 24 with the motor 28, and at the same time the pipe is rotated so that the planishing balls 70 are 90 gradually planish the inside and outside surfaces of the pipe. Rotation of the pipe is effected by means of a drive motor 101 turning the chuck 20 via a chain drive 102 meshing with a sprocket 103 on a hub 104 secured to the chuck. The chuck 20 is mounted for rotation within a pair of bearings 105 and 106 carried by the head 21.

Figure 8:
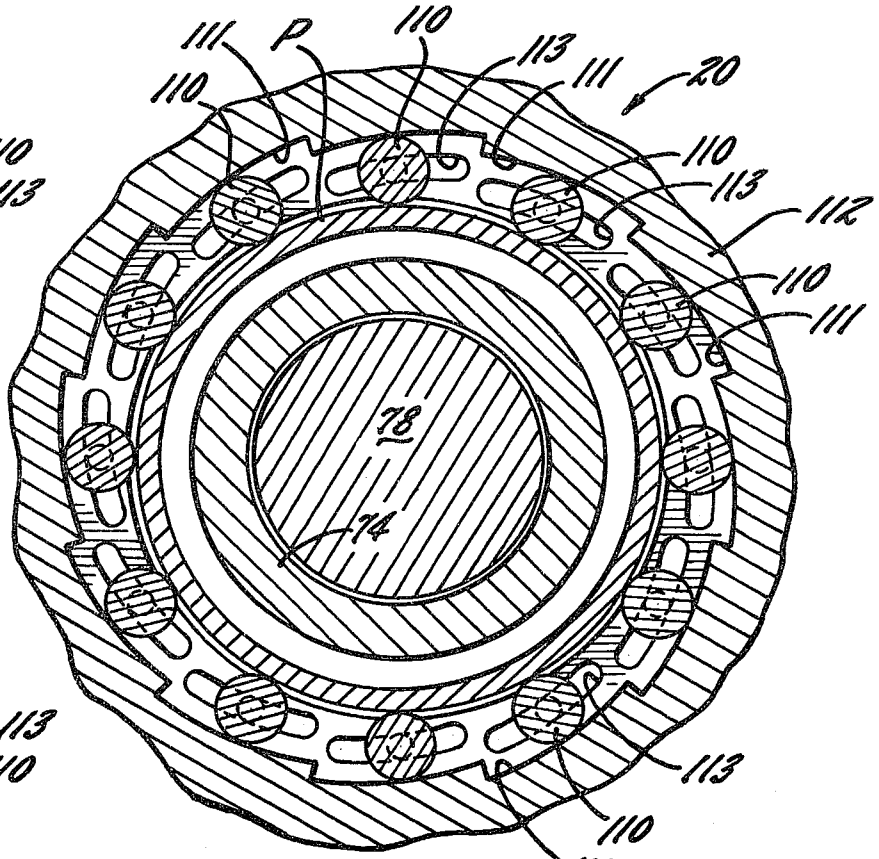
FIG. 8 is a section taken generally along 8—8 in FIG. 7.
Figure 7:
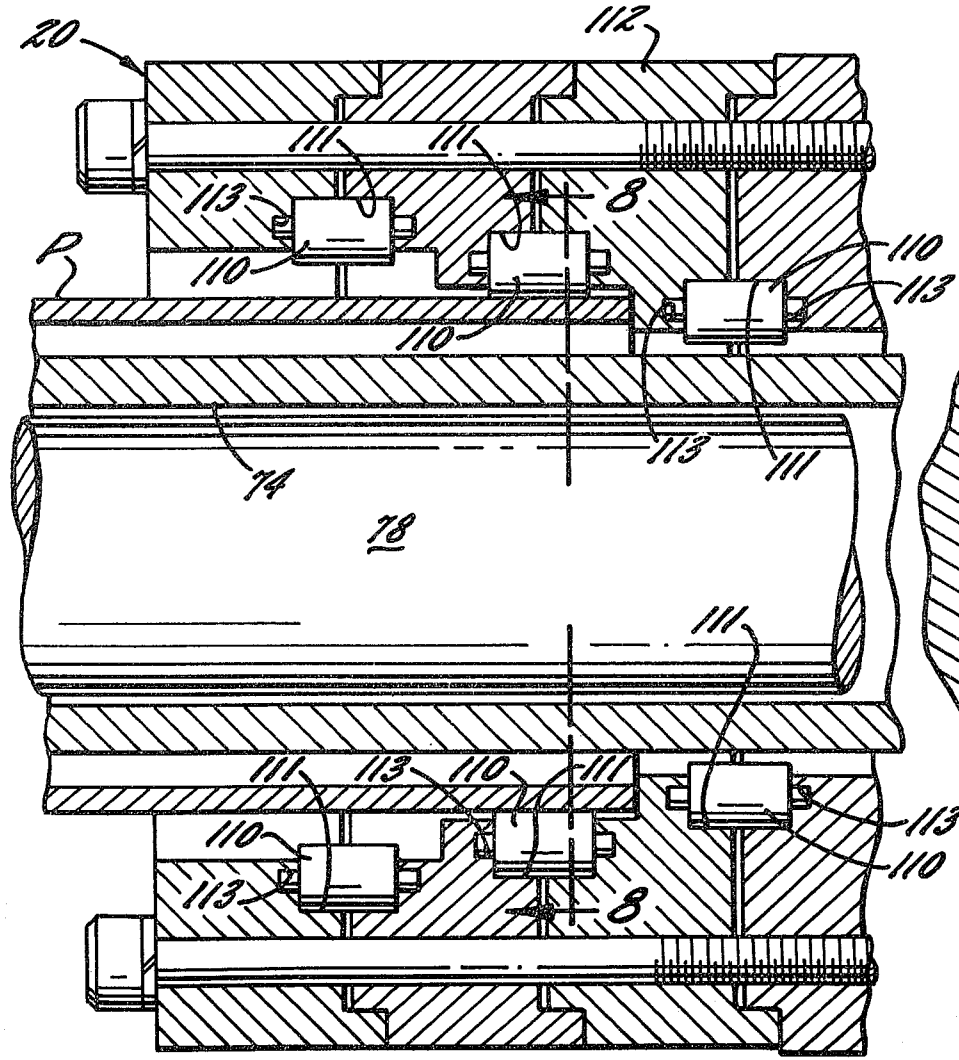
FIG. 7 is an enlarged view of the pipe holding apparatus located at the right-hand end of the pipe shown in FIG. 2.

Although a variety of different devices may be used to secure the end of the pipe P to the rotating chuck 20, a particularly preferred chucking arrangement is illustrated in FIGS. 2, 7 and 8. This is a self-latching chuck comprising three circular arrays of rollers 110 mounted in circles of different diameters for receiving pipes of different diameters. When a pipe is inserted into the chuck, the outside wall of the pipe engages the inner surfaces of the rollers 110 in one of the circular arrays, while the outer surfaces of the rollers ride on cam surfaces 111 formed by a surrounding ring 112. The rollers 110 are held in place by fitting the journals of the rollers 110 into arcuate slots 113 formed by the ring 112 so that the rollers are still free to move along the cam surfaces 111.

Thus, when the chuck 20 is rotated with a pipe P inserted therein, the friction of the rollers 110 against the outside surface of the pipe P causes the rollers 110 to be rolled along the cam surfaces 111 in the direction of rotation of the chuck 20. The cam surfaces 111 thus wedge the rollers 110 firmly against the outer surface of the pipe, thereby locking the pipe within the chuck 20 as long as the chuck continues to rotate. That is, the locking engagement of the rollers 110 with the pipe P is self-energizing, and is maintained as long as the chuck 20 is rotated, with the continued frictional engagement between the rollers 110 and the pipe P urging the rollers in the direction of rotation of the chuck 20 so as to wedge the rollers 110 firmly against the outside surface of the pipe. When rotation of the chuck 20 is stopped, there is no longer any frictional force acting on the rollers 110, and thus they tend to return to an unlatched position. The pipe can then be easily removed from the chuck 20, while the slots 113 hold the rollers 110 in the chuck.

Figure 10:
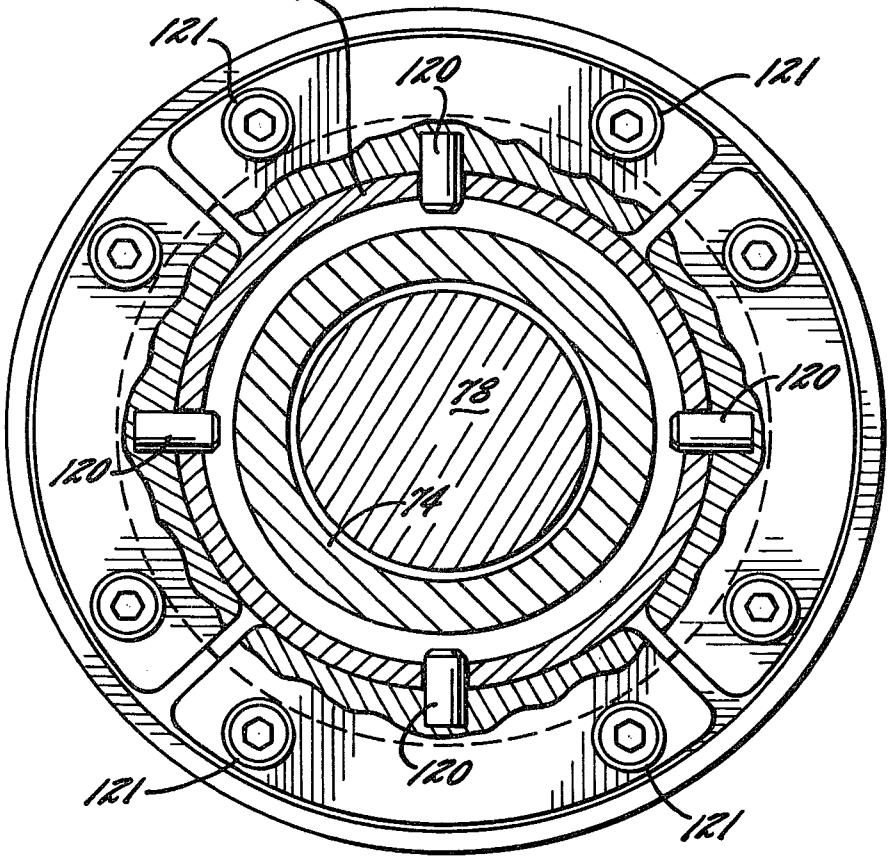
FIG. 10 is a section taken generally along line 10—10 in FIG. 9.
Figure 9:
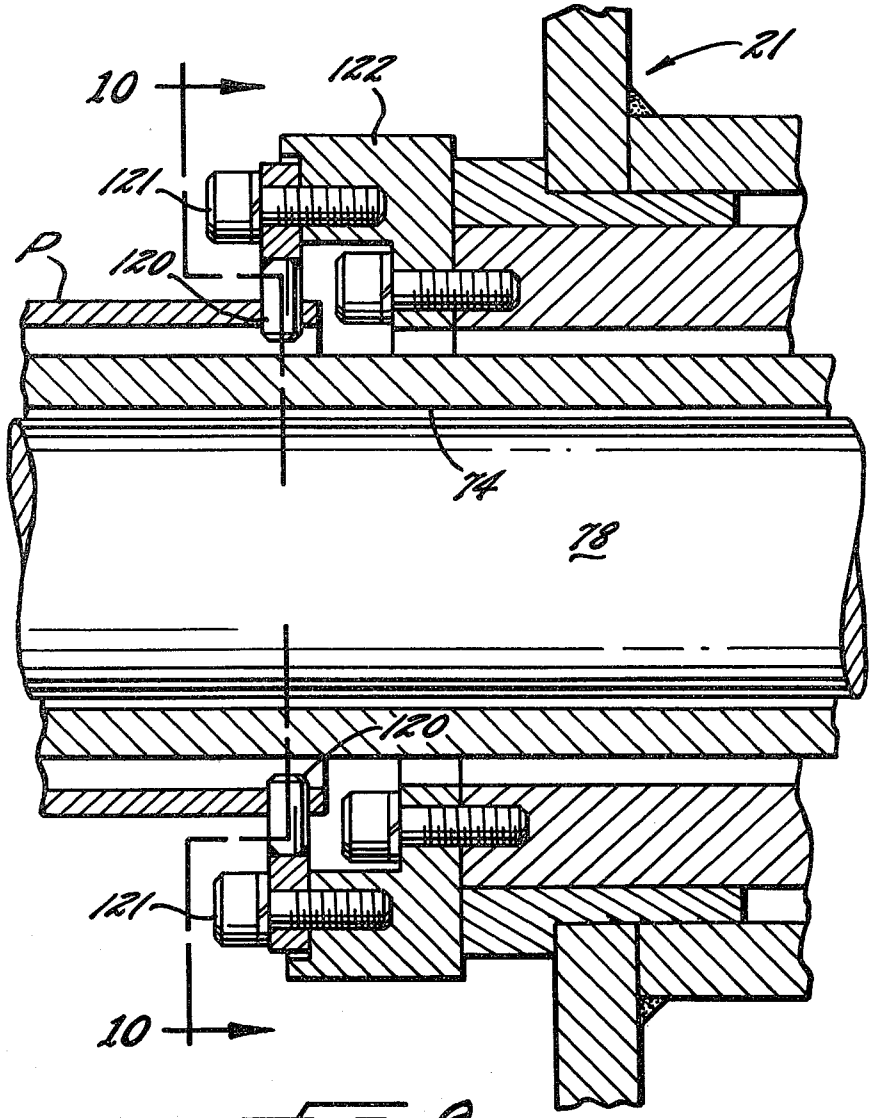
FIG. 9 is an enlarged view similar to that shown in FIG. 7 but illustrating a modified form of pipe holding apparatus.

An alternative chucking arrangement is shown in FIGS. 9 and 10, in which a set of four pins 120 extend radially inwardly from four arcuate segments fastened by screws 121 to a hub 122 driven by the motor 101. With this arrangement, four holes must be drilled in the end of the pipe to receive the pins 120. Thus, the arrangement shown in FIGS. 9 and 10 requires the end portion of the pipe to be cut off after it has been planished, but on the other hand this chucking arrangement is less expensive than the self-locking chuck shown in FIGS. 7 and 8.

As can be seen from the foregoing detailed description, this invention provides a planishing system which is capable of planishing relatively long lengths of metal pipe while applying a circularly symmetrical load on the pipe to avoid bending loads. Thus, the planishing system improves the circular symmetry of the pipe while planishing the pipe. This planishing system improves the strength, corrosion resistance and surface smoothness of the pipe, and is not adversely affected by surface roughness on the pipe. As mentioned, the system is also capable of expanding or shrinking the pipe while it is being planished.

We claim as our invention:

1. A method of treating metal pipe to improve its strength, corrosion resistance and surface smoothness, said method comprising the steps of passing the pipe longitudinally between two concentric circular arrays of independently rotatable planishing element which are urged against the inner and outer surfaces of the pipe at a pressure sufficient to work the surface of the pipe, said independently rotatable planishing elements comprising steel balls which are supported to permit independent rotation of each ball in any direction about its center, the two circular arrays of planishing elements being radially aligned with each other on opposite sides of the pipe wall, and rotating said pipe relative to said two circular arrays of planishing elements while the pipe is being passed therebetween and while said planishing elements are being urged against the inner and outer surfaces of the pipe.

2. A method of treating a metal pipe as set forth in claim 1 wherein said circular array of planishing elements on the inside of the pipe is urged against the pipe with a pressure sufficiently high to expand the pipe while it is passing between the two arrays of planishing elements, and then allowing the pipe to contract after it is passed between the two arrays of planishing elements.

* * * * *